US009144808B2

(12) United States Patent
Zhou et al.

(10) Patent No.: US 9,144,808 B2
(45) Date of Patent: Sep. 29, 2015

(54) SEESAW CONTROL SHOWER

(75) Inventors: Huasong Zhou, Xiamen (CN); Zhongcheng Jin, Fujian (CN); Jianmin Chen, Xiamen (CN); Renzhong Li, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 433 days.

(21) Appl. No.: 13/698,022

(22) PCT Filed: May 13, 2011

(86) PCT No.: PCT/CN2011/074019

§ 371 (c)(1),
(2), (4) Date: Nov. 14, 2012

(87) PCT Pub. No.: WO2011/140996

PCT Pub. Date: Nov. 17, 2011

(65) Prior Publication Data

US 2013/0062439 A1 Mar. 14, 2013

(30) Foreign Application Priority Data

May 14, 2010 (CN) ..... 2010 1 0172716
May 14, 2010 (CN) ..... 2010 2 0191451 U

(51) Int. Cl.

| | |
|---|---|
| ***B05B 1/16*** | (2006.01) |
| ***B05B 1/30*** | (2006.01) |
| ***B05B 1/18*** | (2006.01) |
| ***B05B 12/00*** | (2006.01) |
| ***E03C 1/04*** | (2006.01) |

(52) U.S. Cl.

CPC ..... *B05B 1/30* (2013.01); *B05B 1/1609* (2013.01); *B05B 1/1627* (2013.01); *B05B 1/18* (2013.01); *B05B 12/002* (2013.01); *E03C 1/0409* (2013.01)

(58) Field of Classification Search

CPC ..... B05B 1/1627; B05B 1/16; B05B 1/18; B05B 1/30; B05B 12/002; E03C 1/04; E03C 1/0408; E03C 1/0409

USPC ..... 239/443–449, 562, 583

See application file for complete search history.

(56) References Cited

U.S. PATENT DOCUMENTS

| | | | |
|---|---|---|---|
| 7,007,868 | B1 | 3/2006 | Chen |
| 7,635,095 | B2 | 12/2009 | Jaeger |

FOREIGN PATENT DOCUMENTS

| | | | |
|---|---|---|---|
| CN | 1853797 | A | 11/2006 |
| CN | 200991664 | Y | 12/2007 |
| CN | 201205529 | Y | 3/2009 |
| CN | 101804390 | A | 8/2010 |
| WO | WO-2009006755 | A1 | 1/2009 |

*Primary Examiner* — Christopher Kim

(74) *Attorney, Agent, or Firm* — Rabin & Berdo, P.C.

(57) ABSTRACT

A seesaw control shower has a switch unit and a fixed unit with several outlet functions. The fixed unit has a groove to assemble with the switch unit and connect to the water source. The switch unit has an elastic pushing rod, a seesaw and a driving element. The first end of the pushing rod is connected to the groove. The driving element is and connected to the pushing rod. The seesaw is rotatably disposed inside the groove with one end as the axis. The other end of the seesaw has a W shaped inclined surface forming two apex angles. The second end of the pushing rod can withstand one of the two apex angles rotate the seesaw. The second end of the pushing rod can withstand one of the apex angles to rotate the seesaw.

15 Claims, 5 Drawing Sheets

A-A

A-A

SEESAW CONTROL SHOWER

FIELD OF THE INVENTION

The present invention relates to a shower, especially to a seesaw control shower.

BACKGROUND OF THE INVENTION

Chinese patent application number CN200820102385.2 is provided with an outlet switch shower, which is disposed with a push switch to realize the switch of the waterway. But the structure is complicated with many components. It requires high precision of the components. The control principle is complicated as well. The manufactory cost increases. So that it requires a shower with simple structure and control principle.

SUMMARY OF THE INVENTION

The present invention is provided with a seesaw control shower, which is applied with the seesaw as the control element to corporate with the button. The present invention solves the problem that the structure and the control principle of the existing shower are complicated.

The technical proposal of the present invention to solve the technical problems is as below:

A seesaw control shower includes a fixed unit and a switch unit, the fixed unit is disposed with several outlet functions, the fixed unit is disposed with a groove to assemble with the switch unit and to connect to the water source; the switch unit includes an elastic pushing rod, a seesaw and a driving element, the first end of the elastic pushing rod is sliding and connected to the groove, the driving element is driving and connected to the elastic pushing rod to drive the elastic pushing rod slide, the seesaw is rotatably disposed inside the groove with one end as the axis, the other end of the seesaw is disposed with a W shaped inclined surface, the W shaped inclined surface forms two apex angles, the second end of the elastic pushing rod is withstood one of the two apex angles to push the seesaw to rotate, the multi-functional outlets are switched to connect to the groove is realized by the rotation of the seesaw.

In another preferred embodiment, the switch unit further includes several sealing elements whose number is the same with the outlets, the sealing elements are driving and connected to the seesaw, the sealing element is rotated with the seesaw in the opposite direction to slide inside the groove forward or backward.

In another preferred embodiment, the fixed unit includes two functional outlets, the number of the sealing element is two, the fixed unit further includes two throughout holes to connect to the groove and the outlet functions, the groove is alternatively plugged or connected to the two throughout holes when the two sealing elements slide forward or backward.

In another preferred embodiment, the outlet functions are separately disposed with an independent outlet cavity disposed in the fixed unit and separately connected to the two throughout holes.

In another preferred embodiment, the driving element includes a driving rod sliding and connected to the fixed unit and a button connected to the upper of the driving rod, the lower of the driving rod is withstood with the first end of the elastic pushing rod.

In another preferred embodiment, the top surface of the first end of the elastic pushing rod and the bottom surface of the driving rod are inclined surfaces, which are coupled to each other.

In another preferred embodiment, the fixed unit further includes a sealing cover to cover the groove, the button is disposed out of the sealing cover.

In another preferred embodiment, the elastic pushing rod includes a pushing rod and an elastic element disposed in the lower of the pushing rod, the elastic element is a reposition spring.

In another preferred embodiment, the switch unit further includes a switch base, the outer side of the switch base is disposed with two outer baffles of symmetry, an inner check ring is disposed between the two outer baffles; a leading groove of the elastic elements is formed by the two side outer walls of the inner check ring and the two outer baffles, the elastic pushing rod is assembled inside the inner check ring.

Compared to the existing technology, the present invention of a seesaw control shower has advantages as below:

1. The fixed unit is disposed with a groove to assemble with the switch unit and several outlet functions, the switch of the outlet functions is controlled by the cooperation of the elastic pushing rod, the seesaw with W shaped inclined surface and the driving element. The structure is compact, and the corporation is ingenious. It is space saving and material saving with simplified control principle.

2. The switch unit further included a sealing element, which is linked to the seesaw to seal the waterway of each outlet function or not.

3. The fixed unit further includes a throughout hole to connect the groove and the outlet function. The end of the sealing element is coupled to the throughout hole. The sealing element seals the throughout hole or is connected to the throughout hole to control the outlet functions.

4. Each outlet function has its outlet cavity, which is disposed in the fixed unit. The structure is ingenious.

5. The driving element includes a button out of the fixed unit and a driving rod sliding and connected to the fixed unit under the button, the user can directly push the button to control the outlet functions of the shower.

6. The top surface of the elastic pushing rod and the bottom surface of the driving rod are inclined surfaces. They are coupled to each other to make the linkage of the driving element to the pushing rod and the seesaw more stably and quickly.

7. A sealing cover is covered on the groove, making the shower beautiful with well sealing performance.

8. An elastic element is disposed in the lower of the pushing rod to withstand the pushing rod to make the button reset.

BRIEF DESCRIPTION OF THE DRAWINGS

The present invention will be further described with the drawings and embodiments.

The description of the remarks of the drawings.

Fixed unit—100; groove —110; the first and second outlet—120, 130; the first and second outlet cavity—121, 131; the first and second outlet hole—122, 132; the first and second throughout hole —140, 150; the sealing cover —160; the outlet cover —170; the switch unit —200; the elastic pushing rod —210; the top surface of the first end of the pushing rod 211; the seesaw 220; the first and second apex angle—221. 222; the driving rod —231; the bottom surface of the driving rod—2311; the first and second sealing element—241, 242; the elastic element —250; the switch base —260; the outer baffle —261, the inner check ring —262.

DETAILED DESCRIPTION OF THE EMBODIMENTS

Please refer to FIG. 1 to FIG. 8, which illustrate the seesaw control shower of the preferred embodiment of the present invention.

Figure 1:
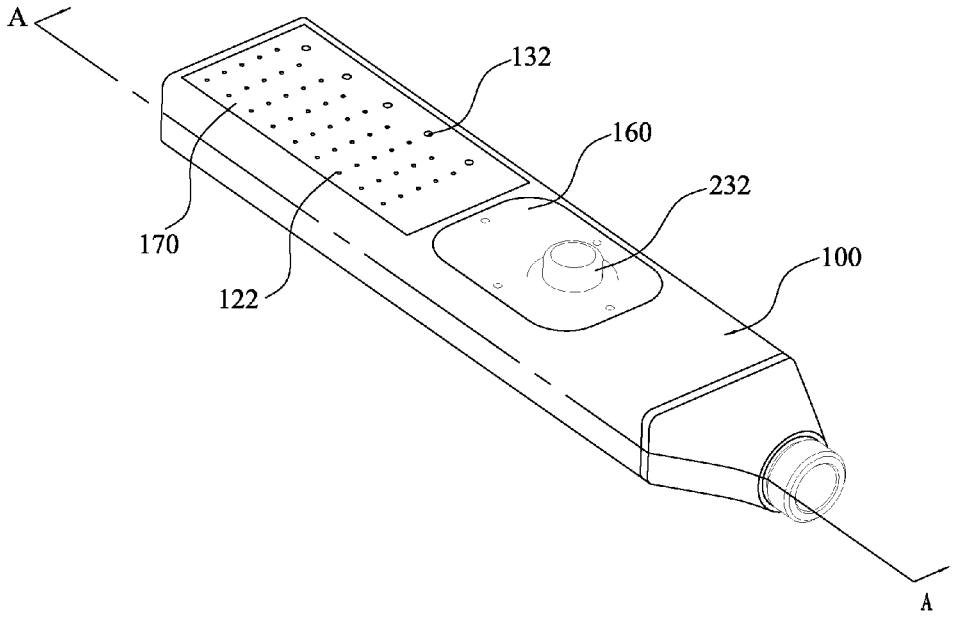
FIG. 1 illustrates the structure of the seesaw control shower of the preferred embodiment of the present invention.

As figured in the FIG. 1, which illustrates the structure of the seesaw control shower. The seesaw control shower includes a fixed unit and a switch unit 200.

Figure 2:
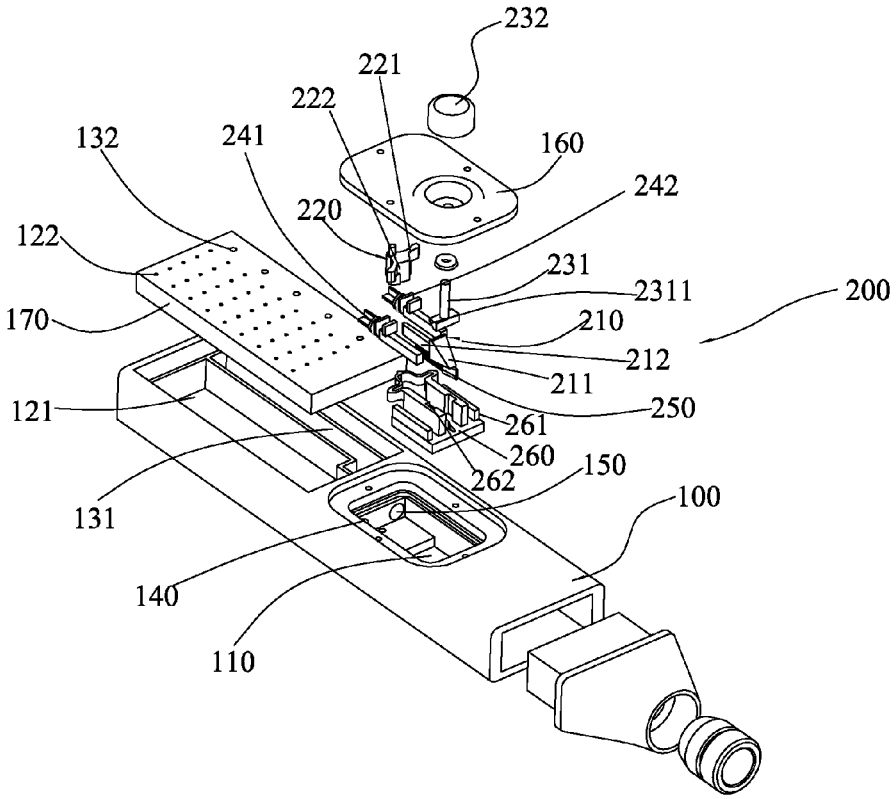
FIG. 2 illustrates the breakdown structure of the seesaw control shower of the preferred embodiment of the present invention.

Combine the FIG. 1 and FIG. 2, the fixed unit 100 is disposed with a groove 110 to assemble with the switch unit and two outlet functions 120, 130. The two outlet functions 120, 130 are separately disposed with an outlet cavity 121, 131 inside the fixed unit. The fixed unit 100 further includes an outlet cover 170 above the outlet cavity 121, 131. There are several first and second outlet holes 122, 132 disposed on the outlet cover 170 and corresponding to the first and second outlet cavity 121, 131. The fixed unit 100 further includes two throughout holes 140, 150 separately corresponding to the first and second outlet cavity 121, 131 to connect to the groove 110 and the outlet function.

The switch unit 200 includes an elastic pushing rod 210, a seesaw 220, a driving element and two sealing elements 241, 242. The elastic pushing rod 210 includes a pushing rod 212 and an elastic element 250 disposed in the lower of the pushing rod 212. They are assembled inside the groove 110 and covered by the sealing cover 160 of the fixed unit 100 inside the fixed unit 100.

Figure 5:
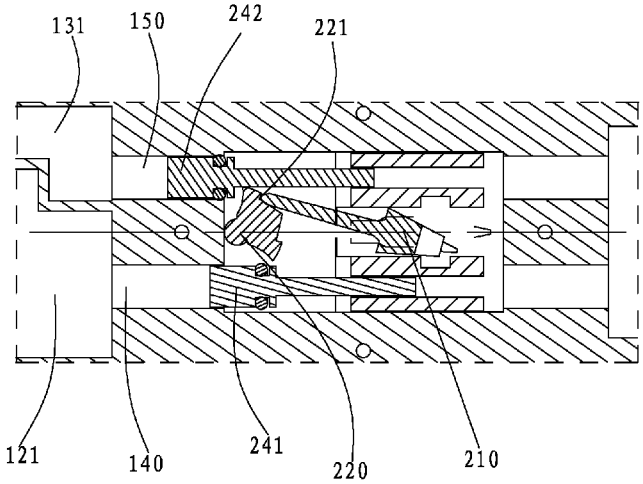
FIG. 5 illustrates the interior structure of the cooperation of the sealing element, the seesaw and the pushing rod of the first outlet terminal when it discharges.
Figure 8:
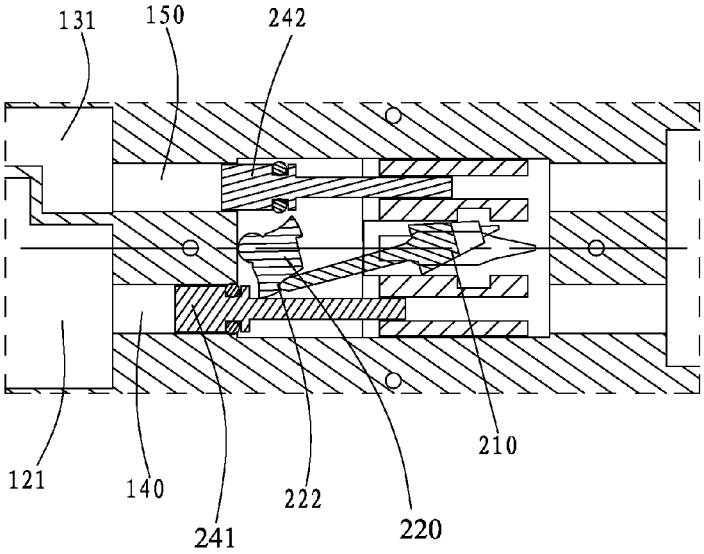
FIG. 8 illustrates the interior structure of the cooperation of the sealing element, the seesaw and the pushing rod of the second outlet terminal when it discharges.

Combine the FIG. 2, FIG. 5 and FIG. 8, which illustrate the detailed structure of the cooperation of each component of the switch unit 200. The first end of the pushing rod 212 is sliding and connected to the groove 110 inside. The seesaw 220 is rotatably disposed inside the groove 110 with one end as the axis. The other end of the seesaw 220 is disposed with a W shaped inclined surface, which forms two apex angles 221, 222; the driving element is driving and connected to the rod 212, the driving element includes a driving rod 212 sliding connected to the fixed unit 100 and a button 232 connected to the upper of the driving rod 231. The bottom surface 2311 of the driving rod 231 and the top surface of the first end of the rod 212 are two inclined surfaces coupled to each other. The button 232 is disposed out of the sealing cover 160 for user's press; two sealing element 241, 242 are separately disposed in the two sides of the seesaw 220. the size of the end of the two sealing element 241, 242 is separately coupled to the two throughout holes 140, 150. two sealing element 241, 242 are linked to the seesaw 220 and sliding inside the groove 110 forward or backward; an elastic element 250 is disposed below the pushing rod 212 and withstood the pushing rod 212. the elastic element 250 is disposed to make the button 232 reset with the driving of the pushing rod 212 and the driving rod 231.

The switch unit 200 further includes a switch base 260, the outer of the switch base 260 is disposed with two outer baffles 261 of symmetry, an inner check ring 262 is disposed between the two outer baffles 261. The two side outer walls of the inner check ring 262 form two leading grooves of the sealing element, the elastic pushing rod 210 is assembled inside the inner check ring 262.

Figure 3:
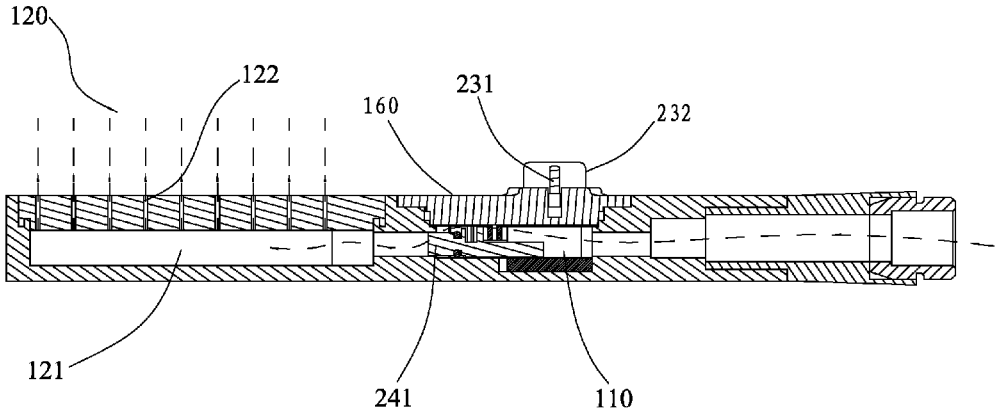
FIG. 3 illustrates the interior structure of the first outlet terminal when it discharges.
Figure 4:
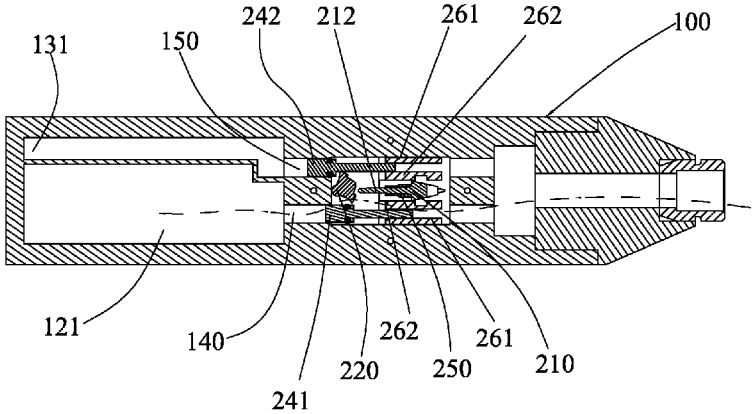
FIG. 4 illustrates the sectional view of the A-A part of the FIG. 1 of the first outlet terminal when it discharges.

FIG. 3, FIG. 4 and FIG. 5 are the structure of the seesaw control shower when the first outlet function 120 discharges.

Turn on the water source, press the button 232, the pushing rod 212 is driven by the driving rod 231 until the second end is withstood the first apex angle 221 of the W shaped inclined surface. The seesaw 220 rotates left to push the second sealing element 242 to slide toward the second throughout hole 150 with the work of the pushing rod 212, while the first sealing element 241 slide in the opposite direction of the first throughout hole 140. As the size of the end of the second sealing element 242 is coupled to the second throughout hole 150, the second throughout hole 150 is plugged by the second sealing element 242. The first throughout hole 140 is not plugged. The first outlet cavity 121 is connected to the groove 110 by the first throughout hole 140, that is to say to be connected to the water source, so the water flows into the first outlet cavity 121 and out of the several first outlet holes 122. Now the water flows out of the first outlet function. In this embodiment, the outlet effect is shower water.

In this seesaw control shower, with the elastic element 250, the button 232 resets after pressed, but the reset will not influence the switch of the outlet functions. Until continue to press the button, making the relative position of the pushing rod 212, the seesaw 220 and two sealing element 241, 242 change, the outlet function is switched. The elastic element 250 is a reposition spring.

Figure 6:
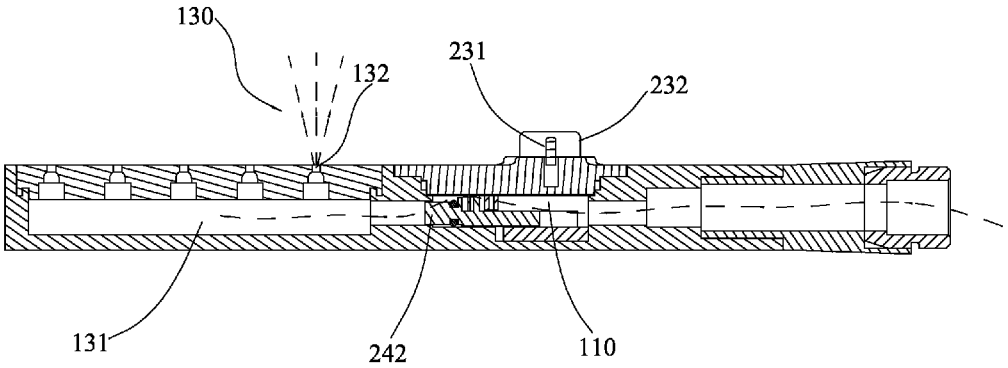
FIG. 6 illustrates the interior structure of the second outlet terminal.
Figure 7:
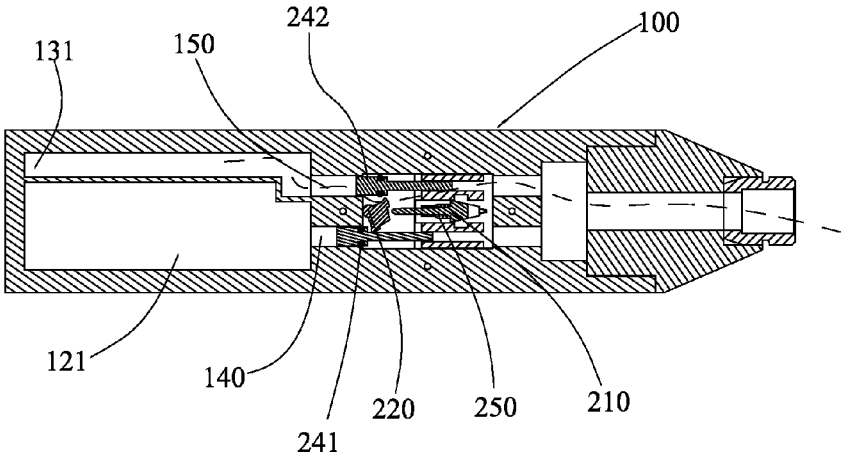
FIG. 7 illustrates the sectional view of the A-A part of the FIG. 1 of the second outlet terminal when it discharges.

FIG. 6, FIG. 7 and FIG. 8 are the structure of the seesaw control shower when the second outlet function 120 discharges.

Continue to press the button 232, the pushing rod 212 is driven by the driving rod 231 until the second end gets out of the first apex angle 221 and withstands the second apex angle 222. the seesaw 220 rotates right to push the first sealing element 241 to slide toward the first throughout hole 140 with the work of the pushing rod 212, while the second sealing element 242 is pushed to sliding in the opposite direction of the second throughout hole 150. as the size of the end of the first sealing element 241 is coupled to the first throughout hole 140, the first throughout hole 140 is plugged by the first sealing element. The second throughout hole 150 is not plugged. The second outlet cavity 131 is connected to the groove 110 through the second throughout hole 150, that is to say the second outlet cavity 131 is connected to the water source, so the water flows into the second outlet cavity 131 and out of the several second outlet holes 132. the water flows out of the second outlet function, in this embodiment, the outlet effect is spray water.

The outlet function of the shower is not limited to be two kinds. It can be designed with more outlet functions by change the structure of the seesaw, the pushing rod and other components according to the above control principle.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

INDUSTRIAL APPLICABILITY

The present invention is provided with a seesaw control shower, in which the second end of the elastic pushing rod alternatively withstands one of the two apex angles to push the seesaw to rotate. The several outlet functions are switched to connect to the groove by the rotation of the seesaw. The structure is compact, and the corporation is ingenious. It's space saving and material saving with simplified control principle and well industrial applicability.

What is claimed is:

1. A seesaw control shower comprising
a fixed unit and a switch unit, wherein:
the fixed unit is disposed with outlets,
the fixed unit is disposed with a groove to assemble with the switch unit and to connect to a water source;
the switch unit includes an elastic pushing rod, a seesaw and a driving element,
a first end of the elastic pushing rod is configured to slide and connected to the groove,
the driving element drives and is connected to the elastic pushing rod to drive the elastic pushing rod to slide,
the seesaw is rotatably disposed inside the groove with one end as its axis, the other end of the seesaw is disposed with a W shaped inclined surface,
the W shaped inclined surface forms two apex angles,
a second end of the elastic pushing rod is configured to push against one of the two apex angles to push the seesaw to rotate,
switching between the outlets connected to the groove is realized by the rotation of the seesaw.

2. The seesaw control shower according to claim 1, wherein
the switch unit further includes sealing elements whose number is the same with the outlets,
the sealing elements are driving and connected to the seesaw,
the sealing elements are rotated with the seesaw in the opposite direction to slide inside the groove forward or backward.

3. The seesaw control shower according to claim 2, wherein
the fixed unit includes two outlets,
the fixed unit further includes first and second throughout holes to connect the groove and the first and second outlets respectively,
the groove is alternatively plugged from or connected to the first and second throughout holes when the respective second and first sealing elements slide respectively forward or backward.

4. The seesaw control shower according to claim 3, wherein the outlets are separately disposed with an independent outlet cavity disposed in the fixed unit and separately connected to the two throughout holes.

5. The seesaw control shower according to claim 1, wherein
the driving element includes a driving rod sliding and connected to the fixed unit and a button connected to the upper of the driving rod,
the lower of the driving rod is withstood with the first end of the elastic pushing rod.

6. The seesaw control shower according to claim 5, wherein the top surface of the first end of the elastic pushing rod and the bottom surface of the driving rod are inclined surfaces, which are coupled to each other.

7. The seesaw control shower according to the claim 5, wherein
the fixed unit further includes a sealing cover to cover the groove,
the button is disposed out of the sealing cover.

8. The seesaw control shower according to claim 1, wherein
the elastic pushing rod includes a pushing rod and an elastic element disposed in the lower of the pushing rod,
the elastic element is a reposition spring.

9. The seesaw control shower according to claim 5, wherein
the switch unit further includes a switch base,
the outer side of the switch base is disposed with two outer baffles of symmetry,
an inner check ring is disposed between the two outer baffles;
a leading groove of the elastic elements is formed by the two side outer walls of the inner check ring and the two outer baffles,
the elastic pushing rod is assembled inside the inner check ring.

10. The seesaw control shower according to claim 2, wherein
the elastic pushing rod includes a pushing rod and an elastic element disposed in the lower of the pushing rod,
the elastic element is a reposition spring.

11. The seesaw control shower according to claim 3, wherein
the elastic pushing rod includes a pushing rod and an elastic element disposed in the lower of the pushing rod,
the elastic element is a reposition spring.

12. The seesaw control shower according to claim 4, wherein
the elastic pushing rod includes a pushing rod and an elastic element disposed in the lower of the pushing rod,
the elastic element is a reposition spring.

13. The seesaw control shower according to claim 5, wherein
the elastic pushing rod includes a pushing rod and an elastic element disposed in the lower of the pushing rod,
the elastic element is a reposition spring.

14. The seesaw control shower according to claim 6, wherein
the elastic pushing rod includes a pushing rod and an elastic element disposed in the lower of the pushing rod,
the elastic element is a reposition spring.

15. The seesaw control shower according to claim 7, wherein
the elastic pushing rod includes a pushing rod and an elastic element disposed in the lower of the pushing rod,
the elastic element is a reposition spring.

* * * * *